US011581661B2

(12) United States Patent
Seo

(10) Patent No.: US 11,581,661 B2
(45) Date of Patent: Feb. 14, 2023

(54) DUAL POLARIZED ANTENNA AND DUAL POLARIZED ANTENNA ASSEMBLY COMPRISING SAME

(71) Applicant: KMW INC., Hwaseong-si (KR)

(72) Inventor: Yong Won Seo, Daejeon-si (KR)

(73) Assignee: KMW INC., Hwaseong-si (KR)

( * ) Notice: Subject to any disclaimer, the term of this patent is extended or adjusted under 35 U.S.C. 154(b) by 0 days.

(21) Appl. No.: 17/503,319

(22) Filed: Oct. 17, 2021

(65) Prior Publication Data

US 2022/0037805 A1 Feb. 3, 2022

Related U.S. Application Data

(63) Continuation of application No. 16/905,940, filed on Jun. 19, 2020, now Pat. No. 11,177,582, which is a (Continued)

(30) Foreign Application Priority Data

Dec. 19, 2017 (KR) ..... 10-2017-0175432

(51) Int. Cl.
*H01Q 21/26* (2006.01)
*H01Q 1/48* (2006.01)
(Continued)

(52) U.S. Cl.
CPC ..... *H01Q 21/26* (2013.01); *H01Q 1/246* (2013.01); *H01Q 1/46* (2013.01); *H01Q 1/48* (2013.01);
(Continued)

(58) Field of Classification Search
CPC ..... H01Q 21/26; H01Q 21/062; H01Q 21/24; H01Q 1/46; H01Q 25/001
See application file for complete search history.

(56) References Cited

U.S. PATENT DOCUMENTS

2014/0049439 A1 2/2014 Ho
2017/0001264 A1 1/2017 Szini et al.
2017/0012364 A1 1/2017 Yang et al.

FOREIGN PATENT DOCUMENTS

CN 201430215 Y 3/2010
CN 102224637 A 10/2011
(Continued)

OTHER PUBLICATIONS

Extended Search Report dated Aug. 17, 2021 from European Patent Office for European Patent Application No. 18891194.5.
(Continued)

*Primary Examiner* — Joseph J Lauture
(74) *Attorney, Agent, or Firm* — Insight Law Group, PLLC; Seung Lee

(57) ABSTRACT

A dual-polarized antenna and a dual-polarized antenna assembly including the same are provided. A dual-polarized antenna includes a base board, feeding unit supported on the base board, and radiation plate supported on the feeding unit. The feeding unit includes a first and a second feeding boards arranged to cross each other on the base board. The first feeding board includes a first feed line configured to supply a first reference-phase signal to a first point on the radiation plate and supply a first antiphase signal having an antiphase relative to the first reference-phase signal to a second point on the radiation plate. The second feeding board includes a second feed line configured to supply a second reference-phase signal to a third point on the radiation plate and supply a second antiphase signal having an antiphase relative to the second reference-phase signal to a fourth point on the radiation plate.

14 Claims, 11 Drawing Sheets

Related U.S. Application Data continuation of application No. PCT/KR2018/015629, filed on Dec. 10, 2018.

(51) Int. Cl.

| | |
|---|---|
| *H01Q 1/24* | (2006.01) |
| *H01Q 1/50* | (2006.01) |
| *H01Q 21/24* | (2006.01) |
| *H01Q 9/42* | (2006.01) |
| *H01Q 25/00* | (2006.01) |
| *H01Q 21/06* | (2006.01) |
| *H01Q 1/46* | (2006.01) |

(52) U.S. Cl.

CPC ..... *H01Q 1/50* (2013.01); *H01Q 9/42* (2013.01); *H01Q 21/062* (2013.01); *H01Q 21/24* (2013.01); *H01Q 25/001* (2013.01)

(56) References Cited

FOREIGN PATENT DOCUMENTS

| | | | | |
|---|---|---|---|---|
| CN | 204189960 | U | 3/2015 | |
| CN | 104868228 | A | 8/2015 | |
| CN | 105449361 | A | 3/2016 | |
| EP | 2835864 | A1 | 2/2015 | |
| JP | 2010-041566 | A | 2/2010 | |
| JP | 2013-247403 | A | 12/2013 | |
| JP | 2016-119551 | A | 6/2016 | |
| KR | 10-2012-0086838 | A | 8/2012 | |
| KR | 10-2013-0134793 | A | 12/2013 | |
| KR | 10-2015-0089509 | A | 8/2015 | |
| KR | 10-2016-0094897 | A | 8/2016 | |
| KR | 10-2016-0124219 | A | 10/2016 | |
| WO | 2012102576 | A2 | 8/2012 | |
| WO | WO-2019124844 | A1 * | 6/2019 | ..... H01Q 1/42 |

OTHER PUBLICATIONS

Office Action dated Jul. 6, 2021 from Japanese Patent Office for Japanese Patent Application No. 2020-550576 and ts English translation.

International Search Report for PCT/KR2018/015629 dated Mar. 18, 2019 and its English translation.

Notice of Allowance dated Jul. 15, 2021 from USPTO for U.S. Appl. No. 16/905,940.

Corrected Notice of Allowance dated Aug. 6, 2021 from USPTO for U.S. Appl. No. 16/905,940.

Corrected Notice of Allowance dated Sep. 16, 2021 from USPTO for U.S. Appl. No. 16/905,940.

Japanese office action dated Dec. 14, 2021 from the Japanese Patent Office for Japanese Application No. 2020-550576 and its English translation.

Korean office action dated Nov. 29, 2021 from the Korean Patent Office for Korean Application No. 10-2017-0175432 and its English translation.

* cited by examiner

DUAL POLARIZED ANTENNA AND DUAL POLARIZED ANTENNA ASSEMBLY COMPRISING SAME

CROSS-REFERENCE TO RELATED APPLICATIONS

This application is a Continuation Application of U.S. application Ser. No. 16/905,940, filed Jun. 19, 2020 (now pending), which is a Continuation Application of International Application No. PCT/KR2018/015629, filed Dec. 10, 2018, which claims priority and benefits of Korean Application No. 10-2017-0175432, filed Dec. 19, 2017, the disclosures of which are incorporated herein by reference in their entirety.

TECHNICAL FIELD

The present disclosure in some embodiments relates to a dual-polarized antenna and a dual-polarized antenna assembly including the same.

BACKGROUND

Massive Multiple Input Multiple Output (MIMO) is a spatial multiplexing technique that utilizes multiple antennas to dramatically increase data transmission capacity, involving a transmitter for transmitting different data by each different transmission antenna and a receiver for distinguishing the transmit data through proper signal processing. Therefore, increasing the number of both transmit and receive antennas by the MIMO technique leads to increased channel capacity for transmitting more data. For example, 10 fold more antennas can secure a channel capacity of about 10 times more for the same frequency band used as compared to employing a single antenna system.

There is more and more emphasis placed on reducing the space occupied by each one of antenna modules, i.e., reducing the size of the individual antennas, as the Massive MIMO technique requires multiple antennas. A dual-polarized antenna is considered to be effective in miniaturizing an antenna structure by having a single antenna element arranged to transmit and receive two electromagnetic wave signals which are perpendicular to each other.

DISCLOSURE

Technical Problem

The present disclosure in some embodiments seeks to provide a dual-polarized antenna which is advantageous for miniaturization of an antenna.

The present disclosure further seeks to provide a dual-polarized antenna capable of reducing the number of contact points and the complexity of signal wiring in manufacturing processes while improving the degree of inter-polarization isolation and the distinguishability between cross polarized waves or cross-polarization distinguishability.

It will be apparent to those skilled in the art from the following description that the subject matter to which the present disclosure is directed is not limited to the challenges set forth above but encompasses other unmentioned technical tasks to be addressed.

SUMMARY

At least one aspect of the present disclosure provides a dual-polarized antenna including a base board, a feeding unit supported on the base board, and a radiation plate supported on the feeding unit.

The feeding unit includes a first feeding board and a second feeding board arranged to cross each other on the base board.

The first feeding board includes a first feed line configured to supply a first reference-phase signal to a first point on the radiation plate and to supply a first antiphase signal having an antiphase relative to the first reference-phase signal to a second point on the radiation plate.

The second feeding board includes a second feed line configured to supply a second reference-phase signal to a third point on the radiation plate and to supply a second antiphase signal having an antiphase relative to the second reference-phase signal to a fourth point on the radiation plate.

According to another aspect of the present disclosure, the dual-polarized antenna assembly includes a casing, multiples of the dual-polarized antenna arranged on the casing, and a radome configured to cover the multiples of the dual-polarized antenna.

Other specific details of the present disclosure are included in the detailed description and drawings.

Figure 1:
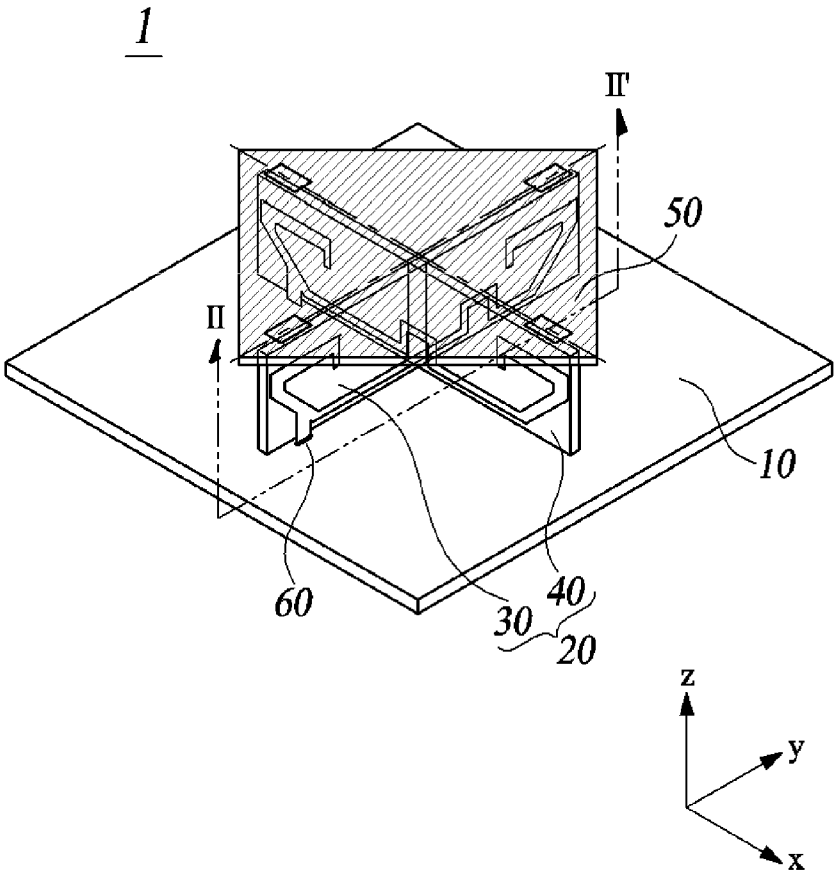
FIG. 1 is a perspective view of a dual-polarized antenna according to at least one embodiment of the present disclosure.

| REFERENCE NUMERALS | |
|---|---|
| 1: dual-polarized antenna | 10: base board |
| 20 feeding unit | 30: first feeding board |
| 40 second feeding board | 50: radiation plate |

DETAILED DESCRIPTION

Hereinafter, some embodiments of the present disclosure will be described in detail with reference to the accompanying drawings. In the following description, like reference numerals designate like elements, although the elements are shown in different drawings. Further, in the following description of some embodiments, a detailed description of known functions and configurations incorporated therein will be omitted for the purpose of clarity and for brevity.

Hereinafter, embodiments of the present disclosure will be described in detail with reference to the accompanying drawings.

FIG. 1 is a perspective view of a dual-polarized antenna according to at least one embodiment of the present disclosure.

Figure 2:
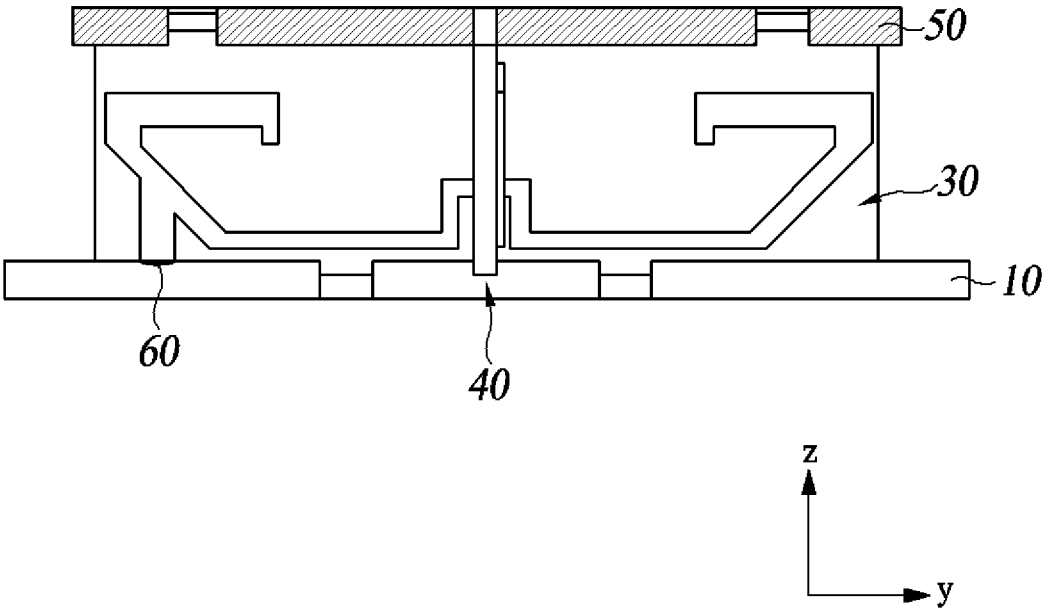
FIG. 2 is a cross-sectional view of the dual-polarized antenna taken along the line II-II' of FIG. 1.

FIG. 2 is a cross-sectional view of the dual-polarized antenna taken along the line II-II' of FIG. 1.

Figure 3:
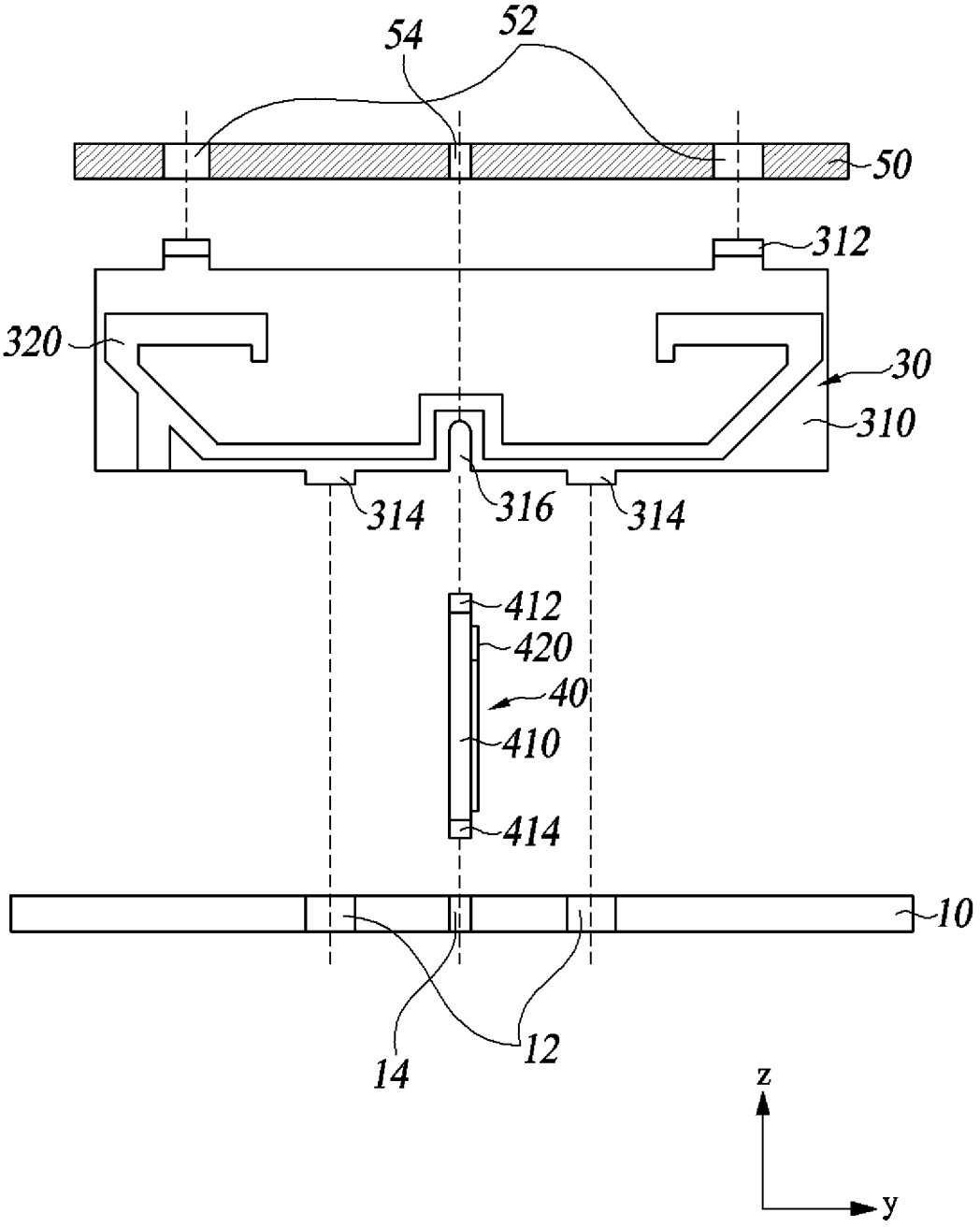
FIG. 3 is an exploded cross-sectional view of the dual-polarized antenna taken along the line II-II' of FIG. 1.

FIG. 3 is an exploded cross-sectional view of the dual-polarized antenna taken along the line II-II' of FIG. 1.

Figure 4:
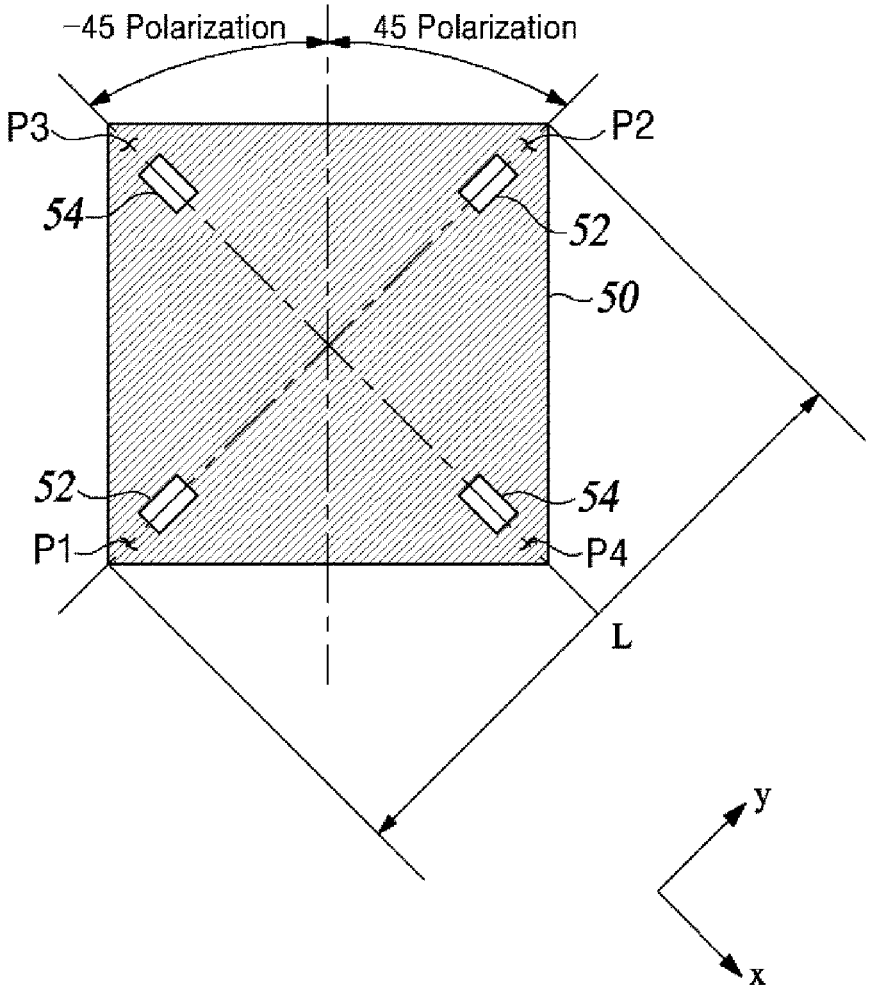
FIG. 4 is a top view of a dual-polarized antenna in accordance with at least one embodiment of the present disclosure.

FIG. 4 is a top view of the dual-polarized antenna in accordance with at least one embodiment of the present disclosure.

As shown in FIGS. 1 to 4, the dual-polarized antenna 1 according to at least one embodiment of the present disclosure includes a base board 10, a feeding unit 20, and a radiation plate 50.

The base board 10 may be a plate-like member made of plastic or metal. The base board 10 may include a ground layer. The ground layer of the base board 10 may provides ground to the dual-polarized antenna while serving as a reflective surface for the radio signal emitted from the radiation plate 50. In this way, the radio signal emitted from the radiation plate 50 toward the base board 10 may be reflected in the main radiation direction. This can improve the front-to-back ratio and the gain of the dual-polarized antenna according to at least one embodiment of the present disclosure.

The feeding unit 20 is configured to be supported on the base board 10 and to supply a high-frequency electrical signal to the radiation plate 50. The feeding unit 20 includes a first feeding board 30 and a second feeding board 40 arranged to cross each other on the base board 10.

In at least one embodiment of the present disclosure, the first feeding board 30 and the second feeding board 40 are vertically upright on the base board 10, and the first feeding board 30 and the second feeding board 40 may cross each other perpendicular to each other at their respective mid-sections.

However, the present disclosure is not limited to this configuration. In an alternative embodiment of the present disclosure, the feed portion 20 may include three or more feeding boards which may be supported on the base board 10 in a variety of ways with structural symmetry.

The first feeding board 30 may be a printed circuit board including a first insulating substrate 310 and a first feed line 320 formed on the first insulating substrate 310. The second feeding board 40 may be another printed circuit board including a second insulating substrate 410 and a second feed line 420 formed on the second insulating substrate 410.

The first feed line 320 and the second feed line 420 may supply high-frequency electrical signals to the radiation plate 50, respectively. In the illustrated embodiment, the first feed line 320 and the second feed line 420 are illustrated as being placed at a short distance from the radiation plate 50 to be electrically capacitively coupled with the radiation plate 50, respectively. However, the present disclosure is not so limited, and in other embodiments, the first feed line 320 and the second feed line 420 may each be in direct electrical contact with the radiation plate 50.

The detailed structure and function of the first feeding line 320 of the first feeding board 30 and the second feeding line 420 of the second feeding board 40 are described in detail below with reference to FIGS. 5 and 6.

The first feeding board 30 may include one or more first substrate coupling protrusions 314 formed on one long side of the first feeding board 30.

The second feeding board 40 may include one or more second substrate coupling protrusions 414 formed on one long side of the second feeding board 40.

Accordingly, the base board 10 may include first substrate-side coupling grooves into which the first substrate coupling protrusions 314 of the first feeding board 30 are inserted and second substrate-side coupling grooves into which the second substrate coupling protrusions 414 of the second feeding board 40 are inserted.

FIG. 1 illustrates the embodiment of the present disclosure wherein the two first and two second substrate coupling protrusions 314 and 414 are formed, and the corresponding two first and second substrate-side coupling grooves are formed in two, respectively. However, the present disclosure is not so limited. In other embodiments of the present disclosure, the number of the substrate coupling protrusions and the coupling grooves may be selectively varied, and further, the first feeding board 30 and the second feeding board 40 may be fastened onto the base board 10 by adhesive or a separate coupling member rather than insertion fastening.

The first feeding board 30 may include a first coupling slit 316 formed on the one long side of the first feeding board 30. The first coupling slit 316 may be a linear opening extending from the center of the one long side of the first feeding board 30 to the inside thereof.

Similarly, the second feeding board 40 may include a second coupling slit 416 (visible in FIG. 6) formed on the other side of the second feeding board 40. The second coupling slit 416 may be a linear opening extending from the center of the other side of the second feeding board 40 to the inside thereof.

The first feeding board and the second feeding board may be arranged to cross each other through the first coupling slit 316 and the second coupling slit 416.

In at least one embodiment of the present disclosure, the first feeding board 30 and the second feeding board 40 may have substantially the same structure and electrical characteristics. For example, the length, width, and thickness of the first feeding board 30 and the second feeding board 40 are largely the same but differ only by a portion of the structural features for allowing the first feeding board 30 and the second feeding board 40 to intersect each other, for example, the direction and structure of the coupling slits and some shape of the accompanying feed lines.

The radiation plate 50 is supported on the feed portion 20, i.e., on the first feeding board 30 and the second feeding board 40. In at least one embodiment of the present disclosure, the radiation plate 50 may be a printed circuit board having a surface formed with a metal layer. The radiation plate 50 may be disposed parallel to the base board 10 and perpendicular to the first and second feeding boards 30 and 40.

In at least one embodiment of the present disclosure, the radiation plate 50 is illustrated as being rectangular with the first feeding board 30 and the second feeding board 40 being disposed diagonally of the radiation plate 50, respectively. However, the present disclosure is not so limited. The shape of the radiation plate 50 may be polygonal, circular, or annular.

The radiation plate 50 may include one or more first radiating plate-side fastening grooves 52 and one or more second radiator-side fastening grooves 54. Accordingly, the first feeding board 30 may have its opposing long side formed with one or more first radiation plate fastening protrusions 312, and the second feeding board 40 may have its opposing long side formed with one or more second radiation plate fastening protrusions 412.

The first and second radiation plate fastening protrusions 312 and 412 may be inserted into and coupled to the first and second radiation plate-side coupling grooves 52 and 54, respectively. This allows the radiation plate 50 to be firmly supported by being spaced apart from the base board 10 through the first and second feeding boards 30 and 40.

The first feed line 320 of the first feeding board 30 supplies a first reference-phase signal to a first point P1 in the radiation plate 50 and supplies a first antiphase signal to a second point P2 in the radiation plate 50.

Similarly, the second feed line 420 of the second feeding board 40 supplies a second reference-phase signal to a third point P3 in the radiation plate 50 and supplies a second antiphase signal to a fourth point P4 in the radiation plate 50.

Here, the first reference-phase signal and the first antiphase signal are high-frequency signals having opposite phases to each other, and the second reference-phase signal and the second antiphase signal are high-frequency signals having opposite phases to each other.

In the dual-polarized antenna according to at least one embodiment of the present disclosure, the straight line connecting first point P1 and second point P2 on the radiation plate 50 and the straight line connecting third point P3 and fourth point P4 on the radiation plate 50 are orthogonal to each other. Therefore, a polarized wave (45 polarization) may be radiated in the direction of the straight line connecting first point P1 and second point P2, and the other polarized wave (−45 polarization) may be radiated in the direction of the straight line connecting third point P3 and fourth point P4.

A distance L between first point P1 and second point P2 and distance L between third point P3 and fourth point P4 depend on a center frequency wavelength λg of the frequency band currently in use, but they may vary depending on the desired characteristics and material. For example, distance L may vary depending on the degree of separation between cross polarized waves or degree of inter-polarization isolation, the half-power beamwidth, and the dielectric constant of the material of the radiation plate 50.

In at least one embodiment of the present disclosure, the first point P1 and second point P2, as with the third point P3 and fourth point P4, may be adjacent to two points furthest from each other on the square radiation plate 50, for example, two vertices that face in a diagonal direction. In particular, the first to fourth points P1 to P4 of the dual-polarized antenna according to at least one embodiment of the present disclosure may be adjacent to the four vertices of the square radiation plate 50, respectively. Therefore, the dual-polarized antenna according to at least one embodiment of the present disclosure can have the most compact structure corresponding to the frequency currently in use.

Figure 5:
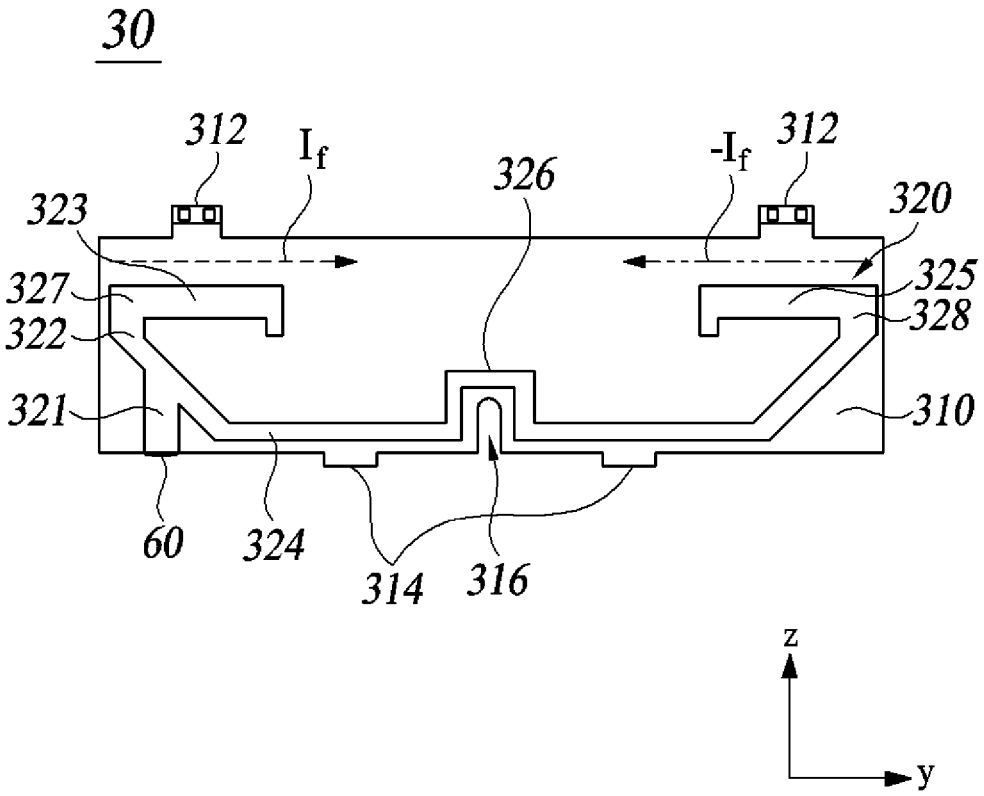
FIG. 5 is a side view of a first feeding substrate or board of a dual-polarized antenna according to at least one embodiment of the present disclosure.

FIG. 5 is a side view of a first feeding board 30 of the dual-polarized antenna according to at least one embodiment of the present disclosure.

As shown in FIG. 5, the first feeding board 30 according to at least one embodiment of the present disclosure includes a first insulating substrate 310 and a first feed line 320 formed on the first insulating substrate 310.

The first feed line 320 may include a first connection line 321, a first reference-phase transmission line 322, a first antiphase transmission line 324, a first reference-phase coupling electrode 323, and a first antiphase coupling electrode 325.

The first connection line 321 may be disposed adjacent to one side of the first feeding board 30 based on the midpoint thereof. The first connection line 321 may be a circuit line extending from one long side of the first feeding board 30 to the inside thereof, for example, toward the other long side of the first feeding board 30. One end of the first connection line 321 may be electrically connected to a signal line of the base board 10 on the one long side of the first feeding board 30. In at least one embodiment of the present disclosure, the first connection line 321 may be connected to a signal line of the base board 10 via a solder joint 60. In particular, the first feeding board 30 of the dual-polarized antenna according to at least one embodiment may be inserted into and soldered to the base board 10 by using a surface mounting device. This can result in a reduction in production costs and improved work efficiency.

The other end of the first connection line 321 may be connected to one end of the first reference-phase transmission line 322 and one end of the first antiphase transmission line 324. In particular, the first reference-phase transmission line 322 and the first antiphase transmission line 324 are branched from the other end of the first connection line 321, so that the first reference-phase transmission line 322 may lead to one end 327 of the first reference-phase coupling electrode 323 and the first antiphase transmission line 324 may lead to one end 328 of the first antiphase coupling electrode 325.

The first reference-phase transmission line 322 has a reference-phase path length extending from the other end of the first connection line 321 to the one end of the first reference-phase coupling electrode 323. The first antiphase transmission line 324 has an antiphase path length extending from the other end of the first connection line 321 to the one end of the first antiphase coupling electrode 325.

In at least one embodiment of the present disclosure, the antiphase path length of the first antiphase transmission line 324 is longer than the reference-phase path length of the first reference-phase transmission line 322, for example, by 0.5 λg. Therefore, the high-frequency electric signal transmitted to the one end of the first antiphase coupling electrode 325 may be delayed before reaching the one end by a difference between the antiphase path length of the first antiphase transmission line 324 and the reference-phase path length of the first reference-phase transmission line 322, for example, by 0.5 λg compared to the high-frequency electric signal transmitted to the one end of the first reference-phase coupling electrode 323. This can provide opposite polarities, i.e., opposite polarities of the same magnitude between the high-frequency electric signal transmitted to the one end of the first reference-phase coupling electrode 323 and the high-frequency electric signal transmitted to the one end of the first anti-phase coupling electrode 325.

The first antiphase transmission line 324 may include a first bypass line 326 formed to bypass the first coupling slit 316. In at least one embodiment of the present disclosure, the antiphase path length of the first antiphase transmission line 324 will be set with the length of the first bypass line added.

The first reference-phase coupling electrode 323 may extend from one short side of the first feeding board 30 toward the other short side thereof. The first reference-phase coupling electrode 323 may be disposed near the other long side of the first feeding board 30 than the one long side thereof that is adjacent to the first connection line 321. The one end of the first reference-phase coupling electrode 323 may be disposed adjacent to the one short side of the first feeding board 30, and the first reference-phase coupling electrode 323 may extend from a position adjacent to the one short side of the first feeding board 30 in parallel with the other long side thereof. The other end of the first reference-phase coupling electrode 323 may have a free end structure.

The first antiphase coupling electrode 325 may extend from the other short side of the first feeding board 30 toward the one short side thereof. The first antiphase coupling electrode 325 may be disposed close to the other long side of the first feeding board 30 than the one long side thereof that is adjacent to the first connection line 321. The one end of the first antiphase coupling electrode 325 may be disposed adjacent to the other short side of the first feeding board 30, and the first anti-phase coupling electrode 325 may extend from a position adjacent to the other short side of the first feeding board 30 in parallel with the other long side of the first feeding board 30.

When a reference-phase electrical signal is applied to the one end of the first reference-phase coupling electrode 323, the applied reference-phase electrical signal will be fed from the one end of the first reference-phase coupling electrode 323 toward the other end thereof, that is, from the one short side of the first feeding board 30 toward the other short side thereof to supply a positive feed current $I_f$ in this feeding direction.

On the other hand, when an antiphase electrical signal is applied to the other end of the first antiphase coupling electrode 325, the applied antiphase electrical signal will be fed from the one end of the first antiphase coupling electrode 325 toward the other end thereof, that is, from the other side of the first feeding board 30 toward the one side thereof to supply a negative feed current $-I_f$ in this feeding direction.

Here, the positive feed current and the negative feed current are to refer to currents having opposite polarities, and the actual values of the positive and negative feed currents may be either positive or negative.

Referring to FIGS. 1 and 4 together, the first reference-phase coupling electrode 323 and the first antiphase coupling electrode 325 may be disposed in one diagonal direction, e.g., a 45 polarization direction, connecting first point P1 and second point P2 of the radiation plate 50. The one end of the first reference-phase coupling electrode 323 may be disposed adjacent to first point P1 of the radiation plate 50, and the first reference-phase coupling electrode 323 may extend from a location adjacent the first point P1 of the radiation plate 50 toward second point P2 of the radiation plate 50. In addition, the one end of the first antiphase coupling electrode 325 may be disposed adjacent to second point P2 of the radiation plate 50, and the first antiphase coupling electrode 325 may extend from a location adjacent second point P2 of the radiation plate 50 in parallel with the radiation plate 50 toward first point P1 of the radiation plate 50.

Accordingly, the first feed line 320 of the first feeding board 30 may supply a reference-phase signal to the first point P1 of the radiation plate 50 and an antiphase signal to the second point P2 of the radiation plate 50. In addition, the reference-phase signal may be fed from first point P1 toward second point P2 of the radiation plate 50, and the antiphase signal may be fed from second point P2 toward first point P1 of the radiation plate 50.

Therefore, according to at least one embodiment of the present disclosure, feeding through at least two points of the radiation plate 50, so-called double feeding, can be accomplished to radiate one polarized wave. In addition, the first feeding line 320 of the first feeding board 30 may form two L probe feeding structures for supplying the radiation plate 50 with two electric signals having opposite phases.

Figure 6:
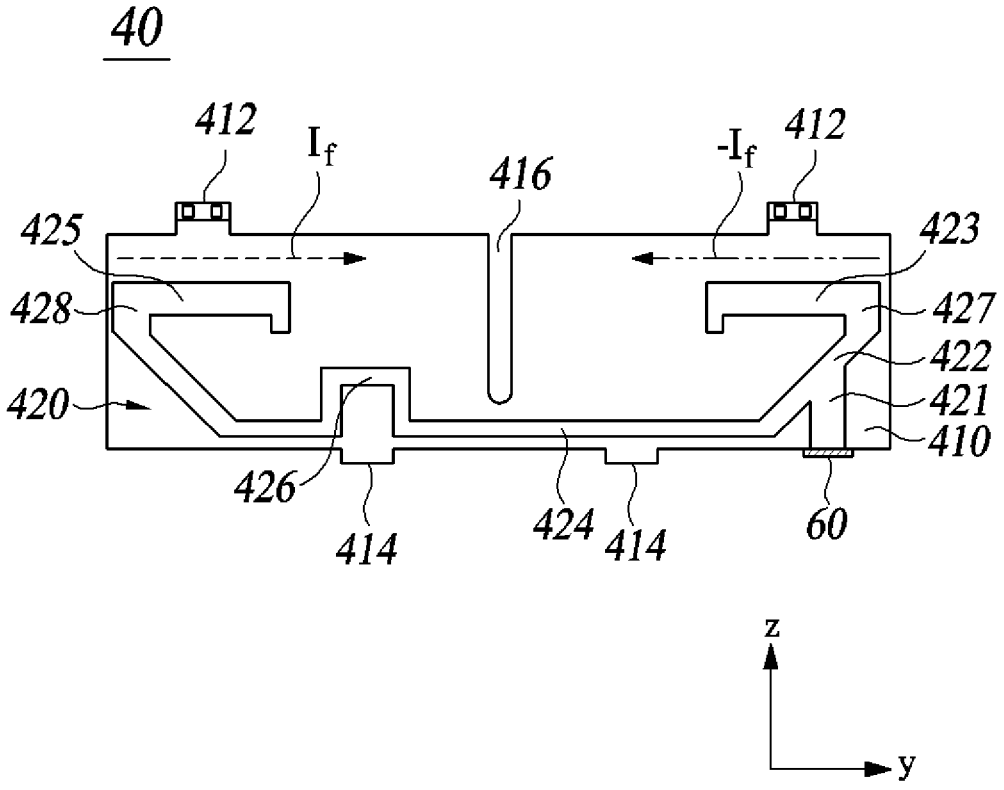
FIG. 6 is a side view of a second feeding substrate or board of a dual-polarized antenna according to at least one embodiment of the present disclosure.

FIG. 6 is a side view of a second feeding board 40 of a dual-polarized antenna according to at least one embodiment of the present disclosure.

As shown in FIG. 6, the second feeding board 40 according to at least one embodiment of the present disclosure includes a second insulating substrate 410 and a second feed line 420 formed on the second insulating substrate 410.

The second feed line 420 may include a second connection line 421, a second reference-phase transmission line 422, a second antiphase transmission line 424, a second reference-phase coupling electrode 423, and a second antiphase coupling electrode 425.

As described above, in at least one embodiment of the present disclosure, the first feeding board 30 and the second feeding board 40 may have similar structures and functions. Therefore, the second feed line 420 of the second feeding board 40 corresponds to the first feeding line 320 of the first feeding board 30 between the second connection line 421 and first connection line 321, the second reference-phase transmission line 422 and first reference-phase transmission line 322, the second antiphase transmission line 424 and first antiphase transmission line 324, the second reference-phase coupling electrode 423 and first reference-phase coupling electrode 323, and the second antiphase coupling electrode 425 and first antiphase coupling electrode 325.

To avoid a duplicate description, the following will concentrate on a different configuration from the first feeding board 30 among those of the second feeding board 40.

The second antiphase transmission line 424 of the second feeding board 40 may include a second bypass line 426. The second bypass line 426 is not configured to bypass the second coupling slit 416, unlike the first bypass line 326. However, the second bypass line 426 is added to the second antiphase transmission line 424 such that the latter has the same antiphase path length as the first antiphase transmission line 324.

Thus, according to at least one embodiment of the present disclosure, the first feed line 320 and the second feed line 420 may have a similar shape as possible, and the symmetry of the entire dual-polarized antenna structure may be maintained.

Referring to FIGS. 1 and 4 together, the second reference-phase coupling electrode 423 and the second antiphase coupling electrode 425 may be disposed in another diagonal direction, e.g., −45 polarization direction, connecting third point P3 and fourth point P4 of the radiation plate 50. One end 427 of the second reference-phase coupling electrode 423 may be disposed adjacent to third point P3 of the radiation plate 50, and the second reference-phase coupling electrode 423 may extend from a location adjacent third point P3 of the radiation plate 50 toward fourth point P4 of the radiation plate 50. In addition, one end 428 of the second antiphase coupling electrode 425 may be disposed adjacent to fourth point P4 of the radiation plate 50, and the second antiphase coupling electrode 425 may extend from a location adjacent fourth point P4 of the radiation plate 50 in parallel with the radiation plate 50 toward third point P3 of the radiation plate 50.

Therefore, the second feed line 420 of the second feeding board 40 may supply a reference-phase signal to third point P3 of the radiation plate 50 and an antiphase signal to fourth point P4 of the radiation plate 50. In addition, the reference-phase signal may be fed from third point P3 toward fourth point P4 of the radiation plate 50, and the antiphase signal may be fed from fourth point P4 toward third point P3 of the radiation plate 50.

Therefore, according to at least one embodiment of the present disclosure, feeding through at least two points of the radiation plate 50, so-called double feeding, can be accomplished to radiate another polarized wave. In addition, the second feeding line 420 of the second feeding board 40 may form two L probe feeding structures for supplying the radiation plate 50 with two electric signals having opposite phases.

Figure 7:
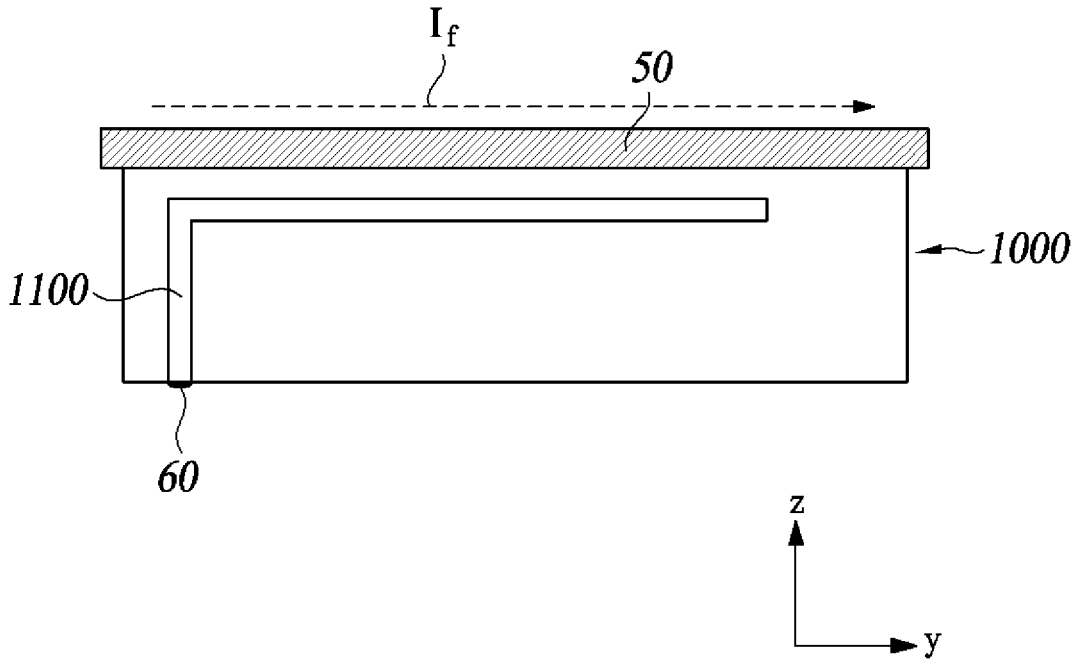
FIG. 7 is a schematic diagram of a comparative example illustrating a single feed scheme.

FIG. 7 is a schematic diagram of a comparative example illustrating a single feed scheme.

Figure 8:
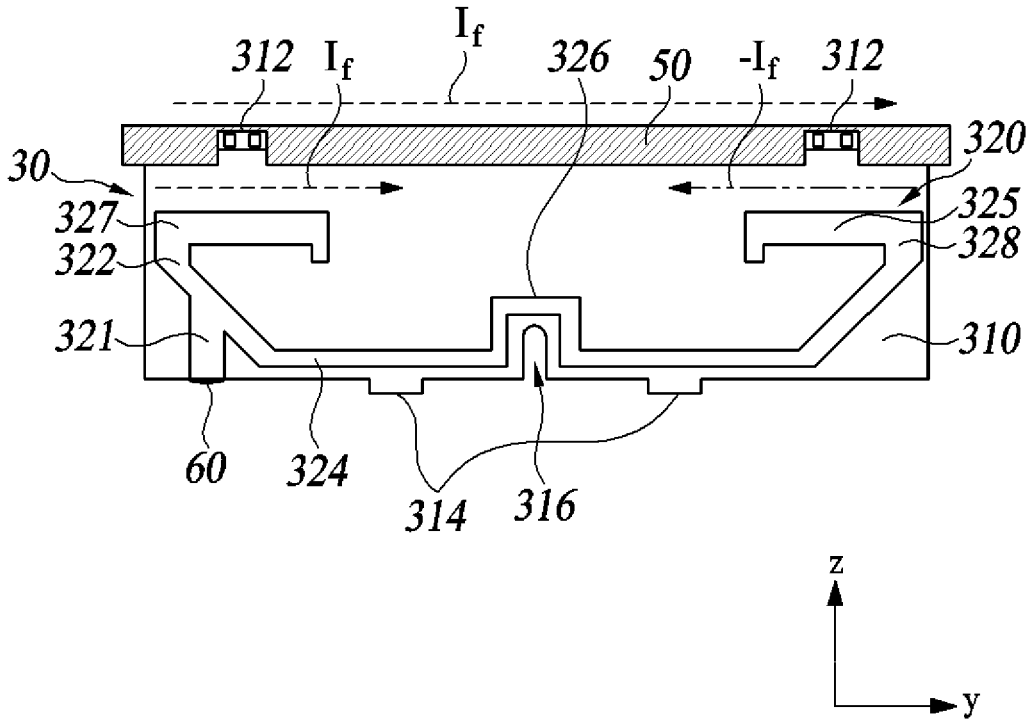
FIG. 8 is a schematic diagram of a feeding method according to at least one embodiment of the present disclosure.

FIG. 8 is a schematic diagram of a feeding method according to at least one embodiment of the present disclosure.

Figure 9:
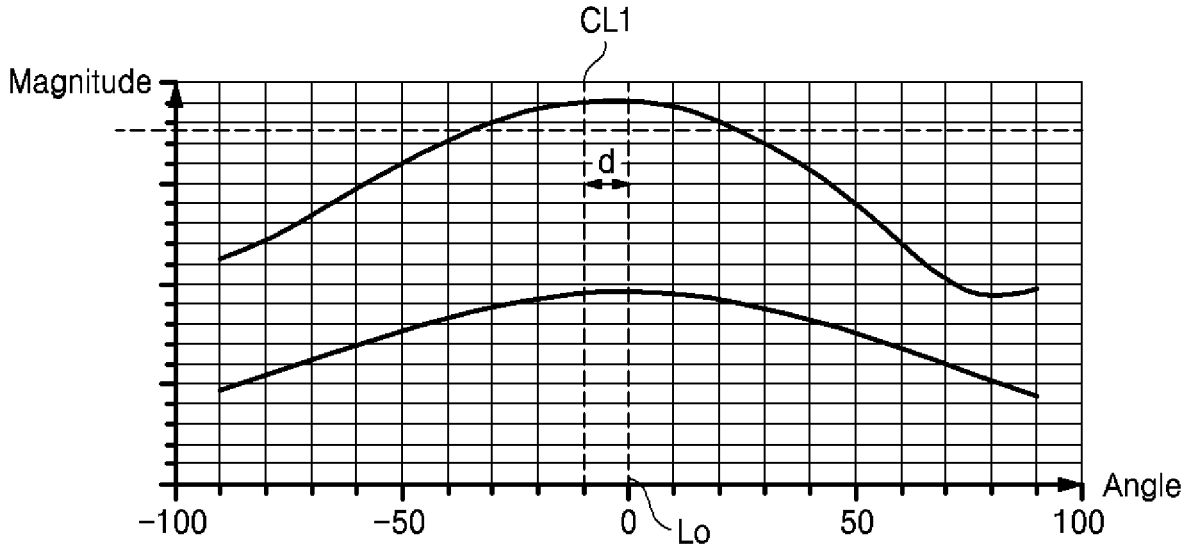
FIG. 9 is a simulation graph of a radiation pattern shown in a structure according to a comparative example.

FIG. 9 is a simulation graph of a radiation pattern shown in a structure according to a comparative example.

Figure 10:
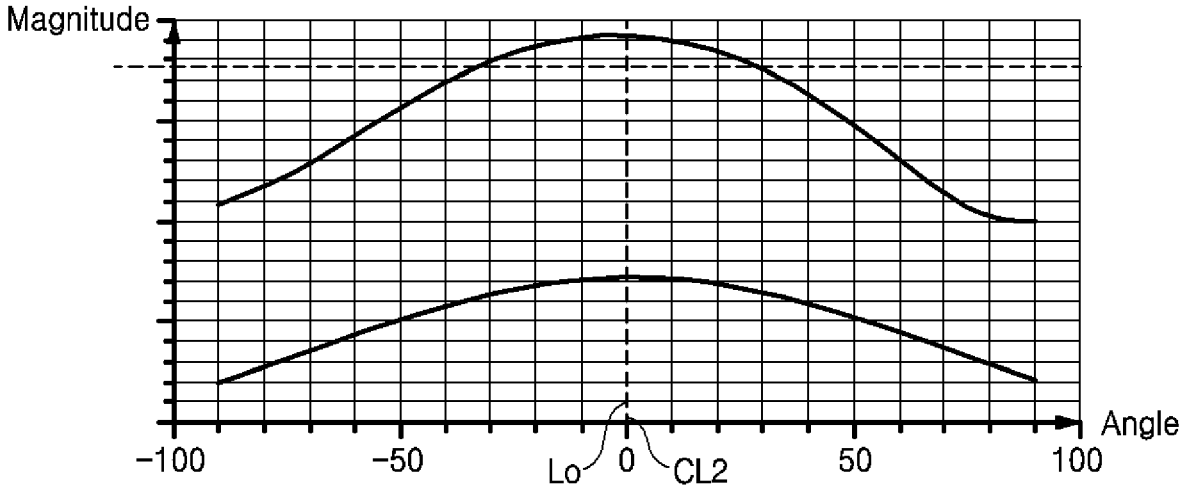
FIG. 10 is a simulation graph of a radiation pattern shown in a feeding method according to at least one embodiment of the present disclosure.

FIG. 10 is a simulation graph of a radiation pattern shown in a feeding method according to at least one embodiment of the present disclosure.

FIG. 7 illustrates, as a comparative example, an exemplary feeding board having an exemplary feed line extending in one direction and a radiation plate 50 supported on the feeding board.

In the comparative example, applied to the exemplary feed line 1100 through a single solder joint 60 is a high-frequency electrical signal which is fed in one direction from one short side of the exemplary feeding board 1000 toward the other short side thereof, or from one point on the radiation plate 50 toward the other.

The signal feeding may induce a feed current flowing in one direction on the radiation plate 50. However, the feed current will have a non-symmetrical distribution on the radiation plate 50 because, in the comparative example, the power supply is unidirectional on the exemplary feeding board 1000. The asymmetry of the feed current causes asymmetry of the electromagnetic wave radiated from the radiation plate 50, which can be an inhibitory factor of antenna quality.

FIG. 9 shows the asymmetry of the radiation pattern according to the comparative example. In the structure according to the comparative example, the center line CL1 of the radiation pattern makes a movement (d) to asymmetry from the reference line LO in the same polarization and is asymmetric.

As shown in FIG. 8, the feeding method according to at least one embodiment of the present disclosure can have a feeding method for radiating a single polarized wave through at least two points of the radiation plate 50, a so-called dual feeding method.

A positive feed current and a negative feed current can be formed in opposite directions by the first reference-phase coupling electrode 323 and the first antiphase coupling electrode 325. In addition, the reverse negative feed current formed in the first antiphase coupling electrode 325 may be interpreted as an electrically positive feed current. Therefore, it can be seen that the first reference-phase coupling electrode 323 and the first antiphase coupling electrode 325 form a feed current in the same direction, which enables the radiation plate 50 to function as a dipole antenna having symmetry.

As shown in FIG. 10, the feeding method according to at least one embodiment of the present disclosure exhibits a symmetrical radiation pattern. In the present structure, the center line CL2 of the radiation pattern is substantially identical to the reference line LO.

In particular, it is noted that the feeding method according to at least one embodiment of the present disclosure can realize a double antiphase feeding to two points of the radiation plate 50 even though the single feeding line of one feeding board is supplied with one high-frequency signal through a single point on the base board 10, for example, a single solder joint 60. This not only simplifies the signal wiring of the base board 10, but requires only a single solder joint 60 or a single connector instead of two, thereby reducing manufacturing processes and improving product reliability.

The conventional dual-polarized antenna structure with a balun when involving the radiation plate 50 as a dual-polarized antenna element would need to provide the base board 10 with a complex signal wiring structure for forming two reference-phase high-frequency signals and two antiphase high-frequency signals. The complex wiring structure will be largely exposed on the bottom surface of the base board 10, thereby deteriorating the degree of inter-polarization isolation, which inhibits the miniaturization of the product.

On the contrary, the dual-polarized antenna according to at least one embodiment of the present disclosure forms a dual antiphase feeding circuit in each of the first and second feeding boards 30 and 40 to overcome such spatial and electrical constraints, which is advantageous for miniaturization of the antenna.

Figure 11:
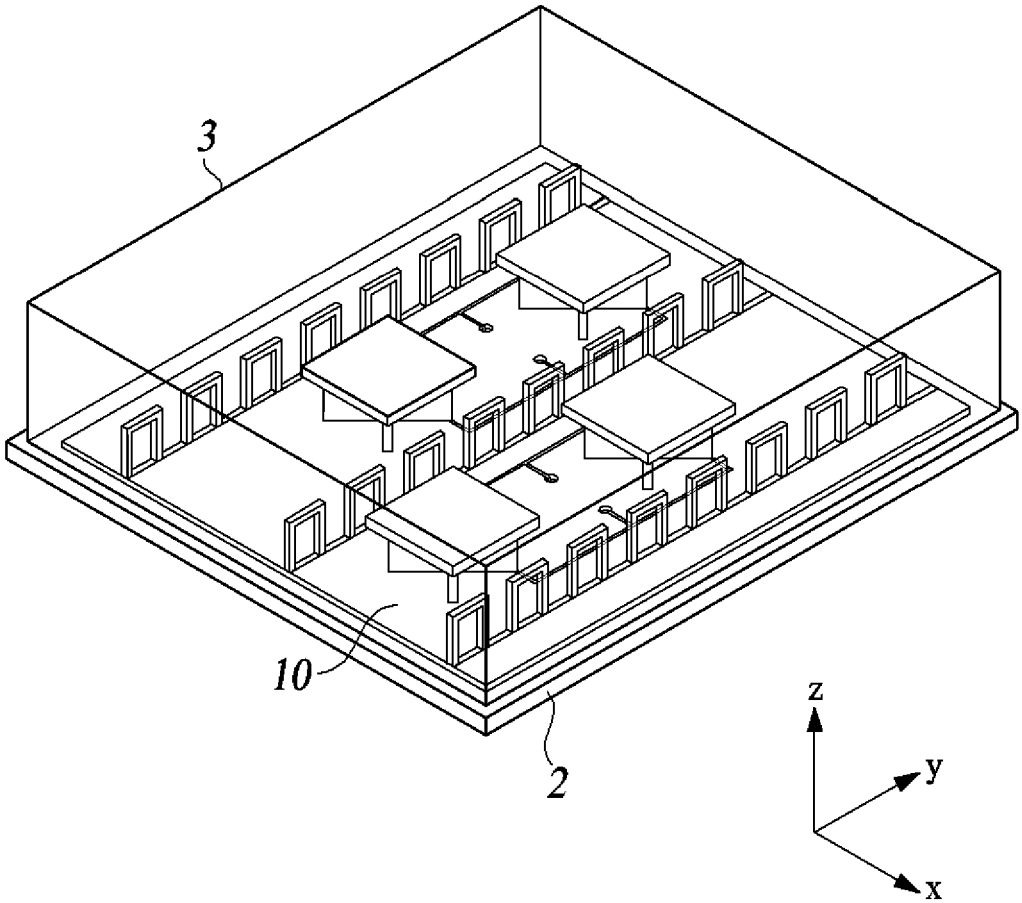
FIG. 11 is a see-through perspective view of a dual-polarized antenna assembly according to at least one embodiment of the present disclosure.

FIG. 11 is a see-through perspective view of a dual-polarized antenna assembly according to at least one embodiment of the present disclosure.

As shown in FIG. 11, the dual-polarized antenna assembly according to at least one embodiment includes a casing 2, a plurality of dual-polarized antennas disposed on one surface of the casing 2, and a radome 3 covering the plurality of dual-polarized antennas.

In the present embodiment, each dual-polarized antenna is substantially the same as the dual-polarized antenna described with reference to FIGS. 1 through 10, and the plurality of dual-polarized antennas share one base board 10.

Although exemplary embodiments of the present disclosure have been described for illustrative purposes, those skilled in the art will appreciate that various modifications, additions, and substitutions are possible, without departing from the idea and scope of the claimed invention. Therefore, exemplary embodiments of the present disclosure have been described for the sake of brevity and clarity. The scope of the technical idea of the present embodiments is not limited by the illustrations. Accordingly, one of ordinary skill would understand the scope of the claimed invention is not to be limited by the above explicitly described embodiments but by the claims and equivalents thereof.

What is claimed is:

1. A dual-polarized antenna, comprising:

a base board;

a feeding unit supported on the base board; and a radiation plate supported on the feeding unit, wherein the feeding unit comprises a first feeding board and a second feeding board arranged to cross each other on the base board, the first feeding board comprises a first feed line configured to supply a first reference-phase signal to a first point on the radiation plate and to supply a first antiphase signal having an antiphase relative to the first reference-phase signal to a second point on the radiation plate, the second feeding board comprises a second feed line configured to supply a second reference-phase signal to a third point on the radiation plate and to supply a second antiphase signal having an antiphase relative to the second reference-phase signal to a fourth point on the radiation plate, the first feed line comprises a singularity of a first reference-phase coupling electrode configured to be disposed adjacent to one short side of the first feeding board and to be extended from the one short side of the first feeding board toward the other short side of the first feeding board, and a singularity of a first antiphase coupling electrode configured to be disposed adjacent to the other short side of the first feeding board and to be extended from the other short side of the first feeding board toward the one short side of the first feeding board, the second feed line comprises a singularity of a second reference-phase coupling electrode configured to be disposed adjacent to one short side of the second feeding board and to be extended from the one short side of the second feeding board toward the other short side of the second feeding board, and a singularity of a second antiphase coupling electrode configured to be disposed adjacent to the other short side of the second feeding board and to be extended from the other short side of the second feeding board toward the one short side of the second feeding board.

2. The dual-polarized antenna of claim 1, wherein the first feed line is configured to supply the first reference-phase signal to the radiation plate from the first point toward the second point and to supply the first antiphase signal to the radiation plate from the second point toward the first point, and wherein the second feed line is configured to supply the second reference-phase signal to the radiation plate from the third point toward the fourth point and to supply the second antiphase signal to the radiation plate from the fourth point toward the third point.

3. The dual-polarized antenna of claim 1, wherein the first reference-phase coupling electrode is configured to extend from the first point in parallel with a direction toward the second point, the first antiphase coupling electrode is configured to extend from the second point in parallel with a direction toward the first point, the second reference-phase coupling electrode is configured to extending from the third point in parallel with a direction toward the fourth point, and the second antiphase coupling electrode is configured to extend from the fourth point in parallel with a direction toward the third point.

4. The dual-polarized antenna of claim 3, wherein the first feed line further comprises:

a first connection line having a first end and a second end, of which the first end is electrically connected to a signal line of the base board on one long side of the first feed feeding board, a first reference-phase transmission line extending from the second end of the first connection line to a first end of the first reference-phase coupling electrode, and a first antiphase transmission line extending from the second end of the first connection line to a first end of the first antiphase coupling electrode, and wherein the second feed line further comprises:

a second connection line having a first end and a second end, of which the first end is electrically connected to the signal line of the base board on one long side of the second feeding board, a second reference-phase transmission line extending from the second end of the second connection line to a first end of the second reference-phase coupling electrode, and a second antiphase transmission line extending from the second end of the second connection line to a first end of the second antiphase coupling electrode.

5. The dual-polarized antenna of claim 4, wherein the first antiphase transmission line has a path length that is longer than a path length of the first reference-phase transmission line by a half wavelength of a center frequency of a frequency currently in use, and the second antiphase transmission line has a path length that is longer than a path length of the second reference-phase transmission line by a half wavelength of the center frequency of the frequency currently in use.

6. The dual-polarized antenna of claim 4, wherein the first reference-phase transmission line and the second reference-phase transmission line have an equal path length, and the first antiphase transmission line and the second antiphase transmission lines have an equal path length.

7. The dual-polarized antenna of claim 4, wherein the first feed line defines two L probe feed structures configured to supply the first reference-phase signal and the first antiphase signal to the radiation plate, and the second feed line forms two L probe feed structures configured to supply the second reference-phase signal and the second antiphase signal to the radiation plate.

8. The dual-polarized antenna of claim 1, wherein the first feeding board and the second feeding board are vertically upright on the base board, and the first feeding board and the second feeding board have respective midsections that intersect perpendicular to each other.

9. The dual-polarized antenna of claim 8, wherein the first feeding board is disposed parallel to a straight line connecting the first point and the second point, and the second feeding board is disposed parallel to a straight line connecting the third point and the fourth point.

10. The dual-polarized antenna of claim 1, wherein the first feeding board has a first long side and a second long side, of which the first long side is formed with at least one first substrate coupling protrusion and the second long side is formed with at least one first radiation plate coupling protrusion, the second feeding board has a first long side and a second long side, of which the first long side is formed with at least one second substrate coupling protrusion and the second long side is formed with at least one second radiation plate coupling protrusion, the base board has a first substrate-side coupling groove into which the first substrate coupling protrusion of the first feeding board is inserted and a second substrate-side coupling groove into which the second substrate coupling protrusion of the second feeding board is inserted, and the radiation plate has a first radiation plate-side coupling groove into which the first radiation plate coupling protrusion is inserted and a second radiation plate-side coupling groove into which the second radiation plate coupling protrusion is inserted.

11. The dual-polarized antenna of claim 1, wherein the radiation plate is square, the first point, the second point, the third point, and the fourth point are adjacent to four vertices of the radiation plate, and the radiation plate has a diagonal of a length that is equal to a half wavelength of a center frequency currently in use.

12. The dual-polarized antenna of claim 1, wherein the first feed line is connected to a signal line of the base board through one solder joint, and the second feed line is connected to another signal line of the base board through another solder joint.

13. The dual-polarized antenna of claim 1, wherein the first feeding board has a first long side and a second long side and includes a first coupling slit extending from a center of the first long side, the second feeding board has a first long side and a second long side and includes a second coupling slit extending from a center of the second long side, and the first feeding board and the second feeding board are arranged to intersect each other through the first coupling slit and the second coupling slit.

14. A dual-polarized antenna assembly, comprising:

a casing;

multiples of the dual-polarized antenna according to claim 1 disposed on the casing; and a radome configured to cover the multiples of the dual-polarized antenna.

* * * * *